United States Patent [19]

Roeder

[11] 3,953,155

[45] Apr. 27, 1976

[54] PUMP PLUNGER

[76] Inventor: George K. Roeder, P.O. Box 4335, Odessa, Tex. 79760

[22] Filed: Nov. 4, 1974

[21] Appl. No.: 520,634

[52] U.S. Cl. ..... 417/554; 92/182
[51] Int. Cl.[2] ..... F04B 21/04; F01B 31/00
[58] Field of Search ..... 92/182; 417/526, 554

[56] References Cited

UNITED STATES PATENTS

| | | | |
|---|---|---|---|
| 1,019,371 | 3/1912 | Schneider | 92/182 |
| 1,636,433 | 7/1927 | Penrod | 92/182 |
| 1,769,820 | 7/1930 | Baird | 92/182 |
| 1,938,383 | 12/1933 | Hair | 92/182 |
| 2,224,916 | 12/1940 | McFarlane | 92/182 |
| 2,702,511 | 2/1955 | McConnohie | 417/526 |
| 2,994,279 | 8/1961 | McGowen | 417/526 |
| 3,565,446 | 2/1971 | Nyberg | 92/182 |
| 3,603,215 | 9/1971 | Leschism | 92/182 |

*Primary Examiner*—William L. Freeh
*Attorney, Agent, or Firm*—Marcus L. Bates

[57] ABSTRACT

A plunger for a downhole pump having a hollow mandrel with a concentrically arranged resilient cylinder thereabout, with an annular chamber formed between the mandrel and the cylinder. The annular chamber is flow connected to the interior of the hollow mandrel so that pressure which is effected within the hollow mandrel also is effected within the annular chamber causing the resilient cylinder to expand radially outwardly into engagement with the interior surface of the working barrel, thereby more efficiently sealing the plunger to the working barrel.

5 Claims, 12 Drawing Figures

PUMP PLUNGER

BACKGROUND OF THE INVENTION

Submerged oil well plunger pumps of the displacement type consist of a plunger and traveling valve reciprocatingly received within a stationary working barrel. The working barrel is provided with a standing valve and is submerged in well fluid and sometimes removably attached to tubing extending to the surface. Reciprocal motion is induced into the traveling valve by a pumpjack by means of a sucker rod string. Sometimes the pump is anchored within the tubing string by special seating attachments engaging suitable shoes disposed on the bottom part of the tubing string thereby enabling removal of the pump by means of the sucker rod rather than having to pull the entire tubing.

The pump plunger of the prior art is provided with various cups and steel followers for effecting the necessary fluid seal between the plunger and working barrel. The specific arrangement of the plunger, tubing, working barrel, valves, and various seals enable the downhole pump assembly to be classified as stationary working barrel, plunger insert, stuffing box plunger insert, inverted plunger or traveling outer tube, and the fluid packed pump assembly.

The present invention relates to improvements in the plunger of a submerged oil well plunger pump and for purpose of illustration, is shown associated with a stationary working barrel.

In the prior art plunger pumps, the seal between the plunger and the working barrel looses its close tolerance fit because of wear which occurs therebetween.

Accordingly, it is desirable to provide the traveling plunger of a downhole submerged pump with means by which the exterior of the plunger is sealed to the interior of the working barrel with the seal being expanded by means of fluid pressure effected within the working barrel, thereby overcoming some of the loss in efficiency generally associated with improper clearance between the wearing surfaces of the plunger and barrel.

SUMMARY OF THE INVENTION

This invention relates to improvements in downhole submerged pump assemblies having a plunger reciprocatingly received within a working barrel. Specifically, the invention resides in a plunger which is provided with a hollow mandrel, a resilient cylinder, and means by which the hollow mandrel is affixed to a reciprocating connecting rod. The cylinder is concentrically arranged about the mandrel and means are provided by which opposed marginal ends of the cylinder sealingly engages opposed ends of the mandrel.

An annular chamber is formed between the mandrel and the cylinder while a port formed through the wall of the mandrel communicates the annulus with the interior of the mandrel so that fluid pressure effected within the mandrel is also effected within the annular chamber thereby causing the cylinder to expand radially outward into sealing engagement with the interior of the barrel.

Therefore, a primary object of the invention is the provision of a pump plunger which sealingly engages the interior of a working barrel with a force which is proportional to the pressure developed by the action of the plunger.

Another object of the invention is the provision of a pump plunger having an expansible fluid actuated wall arranged so that pump fluid pressure outwardly expands the wall into sealing engagement with a pump barrel.

A further object of this invention is the provision of a pump plunger having a plurality of spaced fluid actuated expansible walls.

A still further object of this invention is to provide improvements in pump plunger seal means.

Another and still further object is to provide a plunger having a resilient wall which is slidably sealed to a barrel wall by fluid pressure.

An additional object of this invention is to provide expansible seal means for a pump plunger which is actuated by pump fluid pressure.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
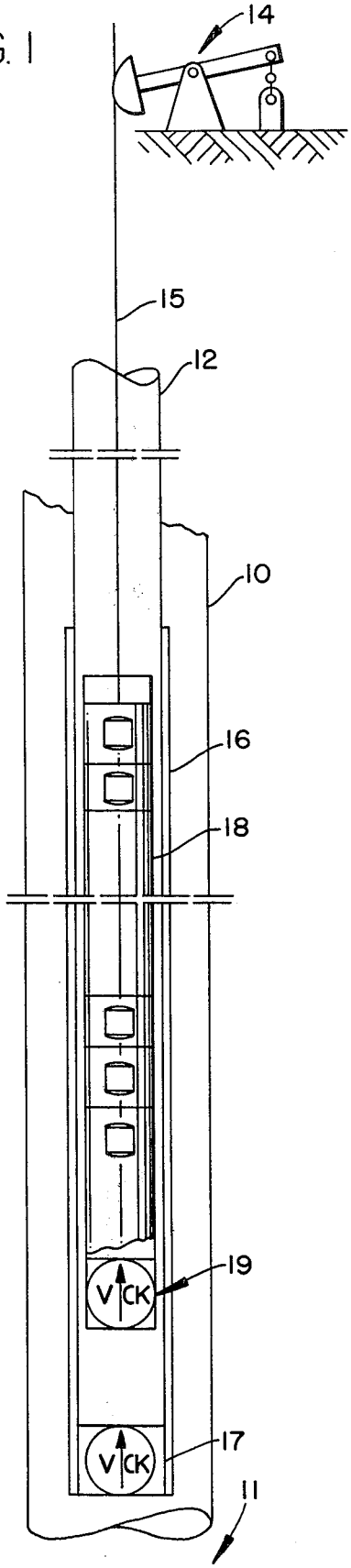
FIG. 1 is a fragmentary part diagrammatical, part schematical representation of a downhole submerged pump assembly having a reciprocating plunger associated therewith of the type embraced by the present invention.

Diagrammatically illustrated in FIG. 1 is a casing 10 placed downhole in the illustrated borehole so that communication can be established from the surface with respect to a hydrocarbon producing zone 11. Production tubing 12 is placed within the casing in the usual manner while a pump jack 14 recirpocates a string of sucker rod 15 with the sucker rod extending down into the proximity of a submerged pump barrel 16. The pump barrel has a conventional check valve 17 which precludes flow of fluid in a downward direction.

A traveling valve element 18, sometimes referred to as a piston, and hereinafter called a plunger, is reciprocatingly received in sealed relationship within the pump barrel. The plunger includes a valve assembly 19 of conventional construction which precludes fluid flow downhole. The plunger is connected to the sucker rod so that the pump jack reciprocates the plunger causing formation fluid to flow uphole through the production tubing and to the surface of the ground.

Throughout the various figures of the drawings, like or similar numerals, wherever it is logical or practical to do so, will refer to like or similar elements.

Figure 2:
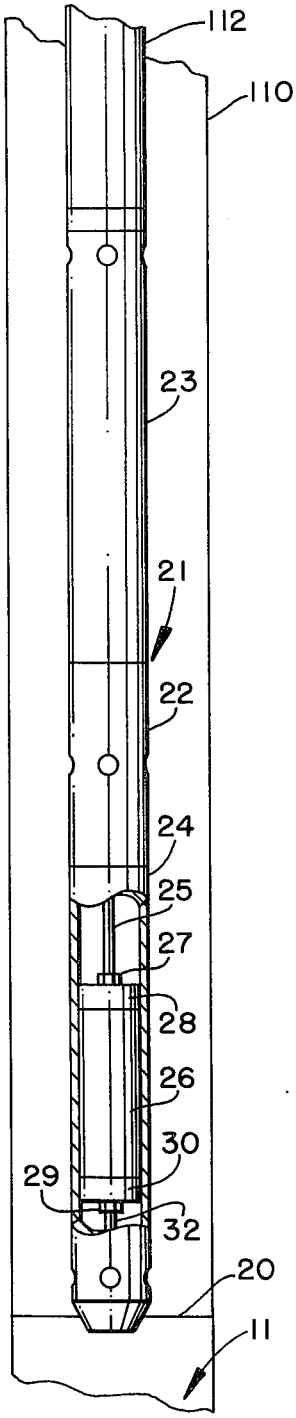
FIG. 2 is a fragmentary, diagrammatical representation of a downhole hydraulically actuated pump having a plunger therein made in accordance with the present invention.

In FIG. 2, there is disclosed a hydraulically actuated pump of the type disclosed in my co-pending patent application, Ser. No. 441,801 filed Feb. 12, 1974. The pump assembly includes a valve assembly 22 which controls the flow of power fluid to the engine. The engine is comprised of opposed cylinders 23 and 24. A hollow fluid conveying connecting rod 25 is affixed to a plunger 26 by means of treaded connection 27. Retainers 28 and 30 define the length of the plunger. The connecting rod continues at 32 into a balance tube as discussed in the before referred to patent application.

Figure 3:
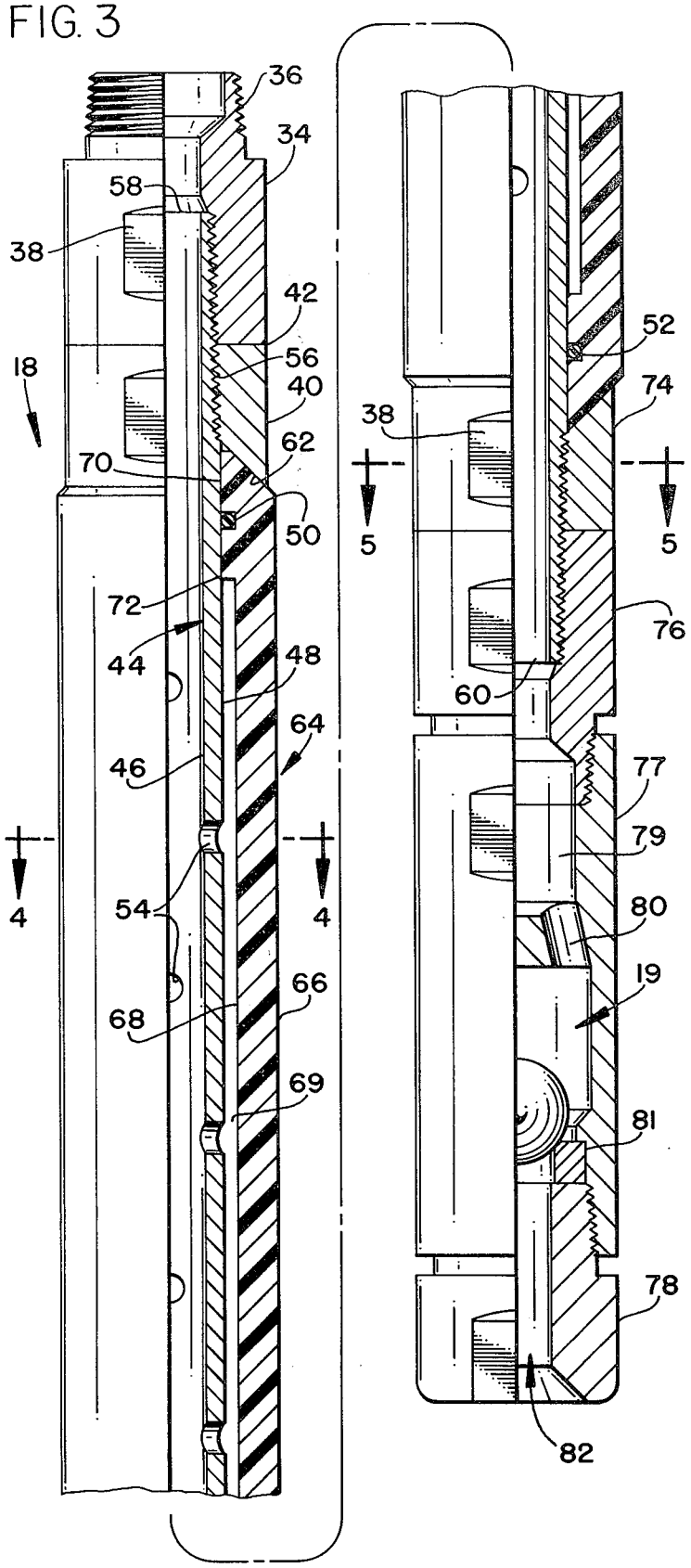
FIG. 3 is a longitudinal, part cross-sectional representation of a plunger made in accordance with the present invention.
Figure 4:
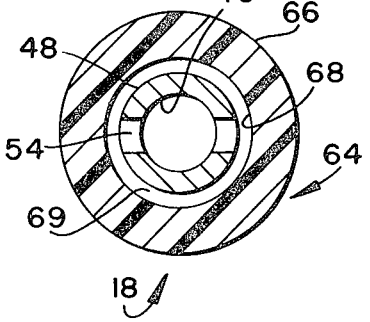
FIGS. 4 and 5, respectively, and cross-sectional views taken along lines 4—4 and 5—5 respectively, of FIG. 3.
Figure 5:
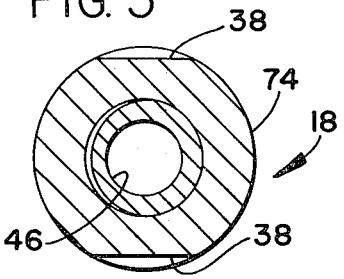

Looking now to the details of FIG. 3, which sets forth the specific embodiment of a plunger for use in conjunction with a string of sucker rod reciprocated by a pumpjack apparatus, the plunger 18 is seen to be comprised of an upper sub 34 having a reduced threaded marginal upper end 36 for connection to the lowermost end of a string of sucker rod. Numeral 38 indicates a wrench flat which facilitates making up the various threaded connections. A compression nut 40 engages the upper sub at interface 42.

A longitudinally extending hollow mandrel 44 has an inside peripheral wall surface 46, and an outside peripheral wall surface 48. Spaced apart o-rings 50 and 52 are placed within a circumferentially extending groove formed in the mandrel. A plurality of radially spaced apart ports 54 are formed through the mandrel wall.

Threaded area 56 threadedly receive the before mentioned upper sub and compression nut while numerals 58 and 60 indicate the upper and lower terminal ends of the mandrel.

A beveled surface 62 wedgedly engages a complimentary surface formed on the upper extremity of the teflon cylinder 64. The outermost surface 66 of the resilient cylinder is spaced from the innermost surface 68 thereof an amount which defines the wall thickness of the cylinder. The inside surface of the cylinder is spaced from the outside surface of the mandrel an amount to form an annular chamber 69 therebetween. While the illustrated annulus is formed by removing material from the inside of the cylinder, it should be understood that the invention also comprehends formation of an annulus by removing material from the outer surface of the mandrel.

The upper end portion 70 of the cylinder increases in thickness at 72 to form the before mentioned annulus, with the before mentioned seal being disposed within the inwardly directed reduced diameter portion of the cylinder. Compression nut 74 is identical with compression nut 40, while sub 76 is similar in many respects to sub 34. Valve sub assembly 77 has a axial chamber 79 formed therein with the radially spaced ports 80 communicating the valve chamber 19. The illustrated ball check valve is seated against a circumferentially extending conventional seat 81 which is maintained in place by a shoulder of the inlet sub 78 bearing thereagainst. Radially spaced flow passageways 80 communicate with up-hole flow through inlet 82.

Figure 7:
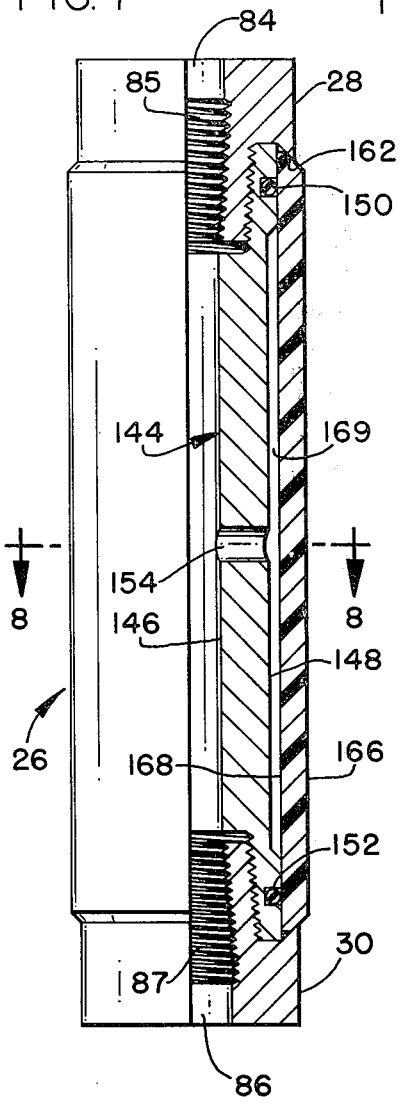
FIG. 7 is a part cross-sectional view of another plunger made in accordance with the present invention.
Figure 8:
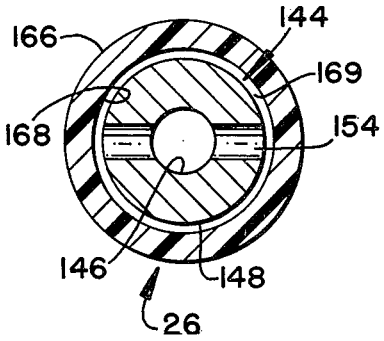
FIG. 8 is a cross-sectional view taken along line 8—8 of FIG. 7.

In the second embodiment of the invention disclosed in FIG. 7, a hollow connecting rod leading to the engine valve assembly (not shown) is connected at 84 while a similar hollow connecting rod leading to a balance tube is connected at 86, for example, assuming that the plunger of FIG. 7 is to be used as the lower piston in a double-ended hydraulic pump. The connecting rod threadedly engages the plunger by means of female thread 85 or 87. Retainers 28 and 30 maintain the teflon cylinder compressed therebetween in a manner similar to the before mentioned retainers 40 and 74.

Figure 9:
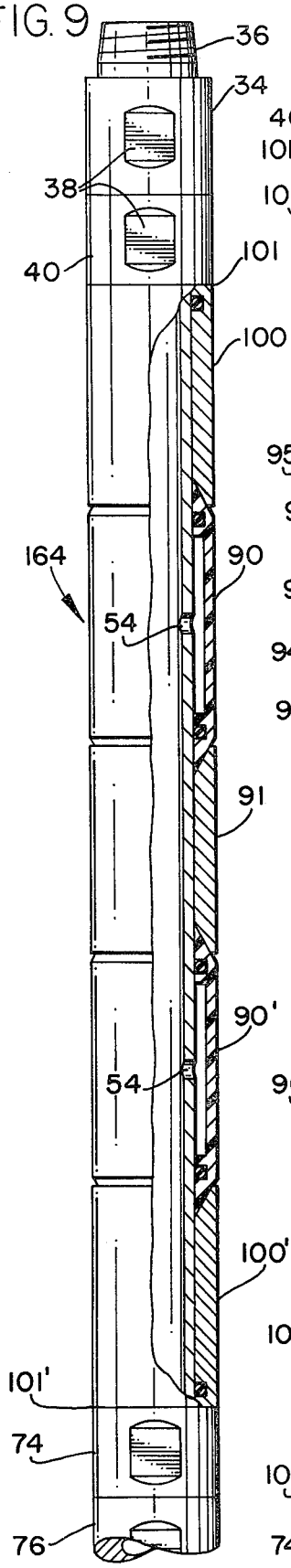
FIG. 9 is an enlarged, fragmentary, part cross-sectional view of the embodiment illustrated in FIG. 10.
Figure 10:
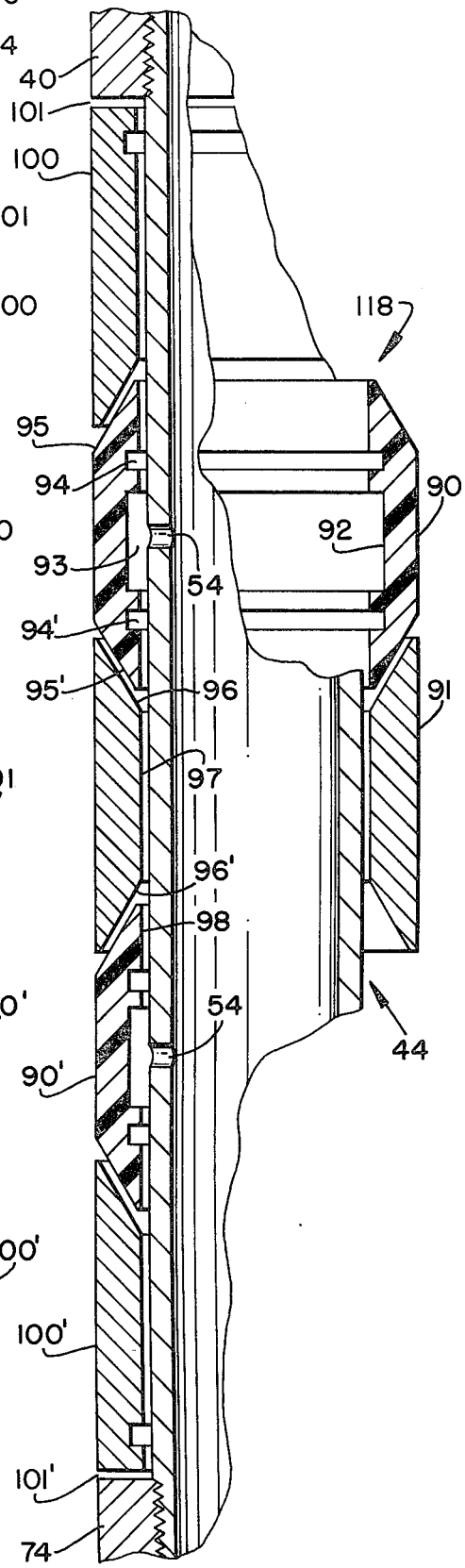
FIG. 10 is a broken, part cross-sectional view of still another embodiment of the invention.

In the embodiment disclosed in FIGS. 9 and 10, retainers 40 and 74 slidably capture therebetween a cylindrical assembly made of a plurality of stacked elements 118, with alternate elements 90 being fabricated of resilient material while the elements 91 adjacent to the resilient cylinders are preferably made of metal. Specifically, spaced teflon packing, or resilient cylinders 90 and 90', are spaced apart by a rigid metallic cylinder 91. The uppermost and lowermost rigid packer elements 100 and 100' are slidably received upon the mandrel along the spaced apart locations defined by spaced interfaces 101 and 101'. One inner marginal surface area of the upper and lowermost packer element is provided with a circumferentially extending o-ring groove, while the opposite end of the packer element is given the illustrated conical configuration, with the sloped edge portion 96 thereof receiving a complementary sloped edge portion 95 of the resilient packer element thereunder in a manner which compresses the opposed sloped edges 95 toward the mandrel as the upper and lowermost slidable elements 100 are moved towards one another.

O-ring grooves 94 and 94' define the length of an annular chamber 93. The annular chamber is in fluid communication with the hollow mandrel by means of port 54.

The I.D. 97 of the metal packer element is slidably fitted to the O.D. of the mandrel in a close tolerance relationship. The I.D. of the opposed marginal ends of the resilient cylinders likewise slidably engage the O.D. of the mandrel with a close tolerance fit. With this in mind, the o-rings 94 and 94' can sometimes be omitted, and the annulus 93 formed in the outermost surface of the mandrel rather than as illustrated.

In operation, an unbalanced fluid pressure between the interior of the mandrel and the suction side of the pump will cause the resilient cylinder to be expanded in an outward direction. For example, in lifting fluid to the surface of the earth with the plunger 18, the increased fluid pressure effected on upstroke within the mandrel is also effected within the annulus 69, thereby balooning the cylinder in an outward direction where it slidably and sealingly engages the inside peripheral wall of the barrel with a force which is proportional to the pressure within the annulus, thereby greatly increasing the sealing action therebetween.

In the embodiment of FIG. 7, hydraulic power fluid is effected within the hollow mandrel through the passageway 154 and into the annulus 169 thereby forcing the cylinder in an outward direction which greatly increases the sealing action between the outer peripheral wall of the plunger and the working barrel of the hydraulic pump. This action occurs on both the up and down-strokes where constant pressure is maintained within the interior of the rod, as for example, as set forth in the above mentioned co-pending patent application.

In sucker rod pumps, the pulsating pressure effected each up-stroke gives the teflon cylinder a breathing effect which sealingly engages the walls with greater force on the upstroke and enables the plunger to more freely travel on the downstroke. This expedient enables additional speed and increased production in some installations.

In the embodiments set forth in FIGS. 9 and 10, the packer elements 164 are slidably received in captured relationship upon the mandrel and are free to individually slide in abuting relationship respective to each other along the limits defined by the spaced shoulders at 101 and 101'.

As the plunger upstrokes, the hydrostatic head representative of the fluid lifted causes a pressure differential across the resilient cylinders. This action deforms the teflon in the illustrated manner of FIG. 6, with the outer surface of the cylinder slidably engaging the inner surface of the barrel with an improved sealing action.

Figure 6:
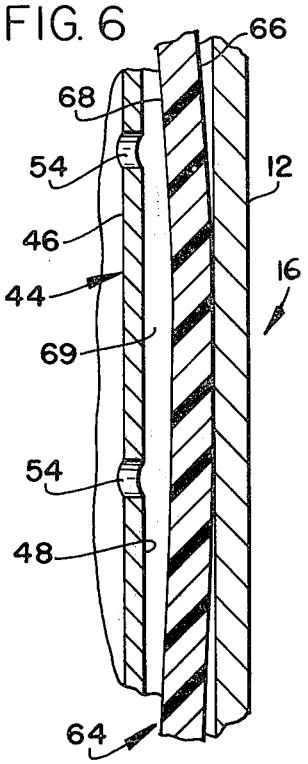
FIG. 6 is an enlarged, fragmentary, cross-sectional view of part of the apparatus disclosed in FIGS. 3 and 7.

As the pump upstrokes, upper member 100 moves toward member 100', thereby compressing opposed edge portions 95 and 95' of the spaced resilient packers towards the mandrel while at the same time the central portion of the packer is forced toward the barrel in the illustrated manner of FIG. 6. This action seals the fluid within the annulus 93 while increasing the effectiveness of the sealing action between the plunger and the barrel so that a greater lifting efficiency is realized by the invention.

The teflon offers a continuous seal under pressure as wear progresses in the assembly. The inherent low friction of the teflon cylinders increases the efficiency of operation, while the ballooning effect provides a self-centering plunger which overcomes the heretofore side biased effect usually brought about in prior art pumps as a consequence of hydrostatic load. Moreover, the wiping effect of the teflon against the barrel reduces many of the problems heretofore associated with abrasive debris entering the pump barrel, including sand problems.

Figure 11:
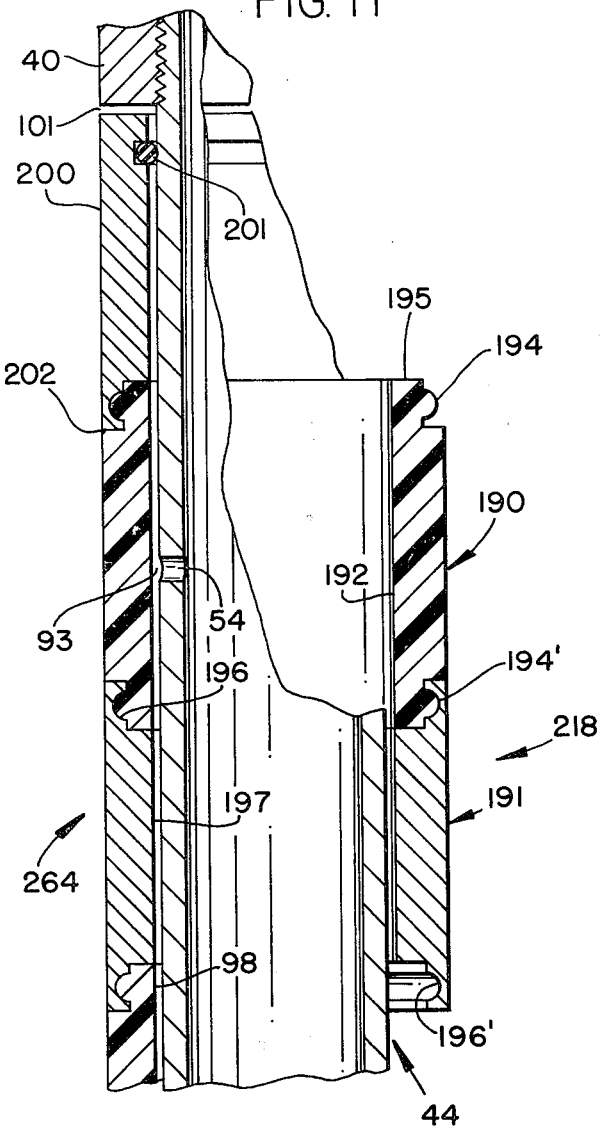
FIG. 11 is a fragmentary, part cross-sectional representation of a modification of the pump plunger of FIGS. 1, 3, and 9.
Figure 12:
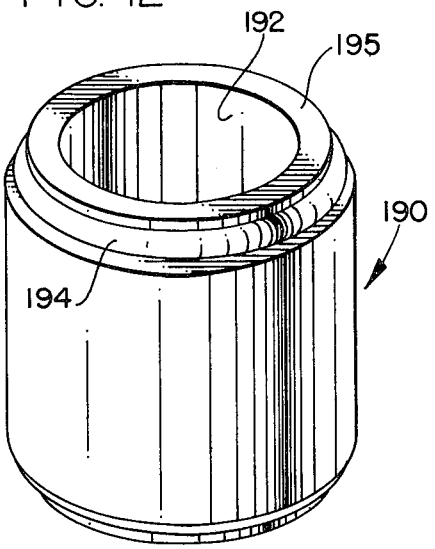
FIG. 12 is a perspective view of part of the plunger assembly seen illustrated in FIG. 11.

In the embodiment of the invention disclosed in FIGS. 11 and 12, the teflon cylinder 190 has a smooth interioral circumferentially extending side wall 192 which slidably engages the circumferentially extending exterioral side wall of the mandrel in a manner similar to the before described embodiments of the invention, except that the opposed marginal ends of the resilient cylinders are "locked" onto the opposed marginal ends of the metal cylinders 191 by the illustrated seal ring 194. The seal ring is made integrally with respect to the remainder of the resilient cylinder.

Each of the spaced rigid packer elements 200 are provided with an o-ring seal 201 on the interior thereof for precluding fluid flow from annulus 93 thereacross.

Each of the spacer rigid cylinders 264 are provided with an annular seal groove 196 and 196' for sealingly engaging the before mentioned outwardly directed seal 194.

The tolerance between the wall 197 and the outer wall of the mandrel must be of a value to form the illustrated annulus 93, otherwise a flow port 54 must be aligned with each resilient cylinder in order that fluid pressure can be effected between the cylinder and the mandrel for the ballooning action therebetween.

I claim:

1. In a downhole submerged pump assembly having a connecting rod affixed to a plunger, said plunger being reciprocatingly received in sealed relationship within a working barrel, and means including a valve arranged to force fluid to flow uphole from the pump assembly when the rod reciprocates the plunger, the improvement comprising:

said plunger having a hollow mandrel, a resilient cylinder, said cylinder being concentrically arranged about said mandrel, seal means by which opposed marginal ends of said cylinder sealingly engage opposed spaced marginal lengths of said mandrel, said plunger includes an upper and a lower sub, and an upper and a lower compression nut, said upper and lower compression nuts being spaced from one another by said resilient cylinder;

means forming beveled surfaces on each of said nuts and on each marginal end of said resilient cylinder such that each said nut wedgedly engages one opposed marginal end of said cylinder;

said upper and lower subs being spaced from one another by said nuts; means by which said upper sub and said upper nut abut one another and threadedly engage an upper marginal length of said mandrel; means by which said lower sub and said lower nut abut one another and threadedly engage a lower marginal length of said mandrel;

said cylinder having an inner, longitudinally extending, elongated midportion which is greater in diameter than the opposed marginal ends thereof to thereby form an annular chamber of limited length between said mandrel and said cylinder; means forming a port in a midportion of said mandrel for communicating said annulus with the interior of said mandrel;

means forming an outlet port in said upper sub through which fluid can flow from the interior of the mandrel; said connecting rod being affixed to said upper sub; said valve means including a traveling valve means affixed to said lower sub for enabling produced fluid to travel into said mandrel on the downstroke of the pump assembly;

whereby fluid pressure effected within said mandrel is also effected within said annular chamber for causing the resilient cylinder to expand radially outward into sealing engagement with the interior of the barrel when the plunger lifts fluid on the upstroke.

2. The improvement of claim 1 wherein said seal means includes o-rings interposed between the opposed reduced diameter marginal ends of said cylinder and opposed marginal lengths of the outer peripheral surface of said mandrel.

3. The improvement of claim 1 wherein said resilient cylinder is made of Teflon.

4. The improvement of claim 1 wherein said seal means includes o-rings interposed between the opposed reduced diameter marginal ends of said resilient cylinder and opposed marginal lengths of the outer peripheral surface of said mandrel; and, said resilient cylinder is made of Teflon.

5. The improvement of claim 1 wherein said seal includes a circumferentially extending groove formed on an inside wall surface of said opposed ends of said resilient cylinder, an o-ring in each said groove for sealingly engaging the outer peripheral surface of the mandrel.

* * * * *